US009976277B2

(12) United States Patent
van Amelsfoort

(10) Patent No.: US 9,976,277 B2
(45) Date of Patent: May 22, 2018

(54) APPARATUS AND METHOD FOR COUPLING WORK TOOL TO A MACHINE

(71) Applicant: Caterpillar Work Tools B.V., s-Hertogenbosch (NL)

(72) Inventor: Edward van Amelsfoort, Tilburg (NL)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 14 days.

(21) Appl. No.: 15/352,086

(22) Filed: Nov. 15, 2016

(65) Prior Publication Data

US 2017/0145652 A1 May 25, 2017

(30) Foreign Application Priority Data

Nov. 24, 2015 (GB) ..... 1520728.5

(51) Int. Cl.
*E02F 3/36* (2006.01)
*E02F 3/32* (2006.01)

(52) U.S. Cl.
CPC ..... *E02F 3/3636* (2013.01); *E02F 3/32* (2013.01); *E02F 3/365* (2013.01); *E02F 3/3618* (2013.01)

(58) Field of Classification Search
CPC ..... E02F 3/3618; E02F 3/365
See application file for complete search history.

(56) References Cited

U.S. PATENT DOCUMENTS 3,118,369 A * 1/1964 Antonucci ..... B41J 29/02 101/480
3,887,096 A * 6/1975 Wieland ..... E02F 3/36 16/267
4,056,250 A * 11/1977 Uchiyama ..... E02F 3/382 248/674
4,283,157 A * 8/1981 Kowalski ..... F16B 7/0446 403/297
4,295,287 A * 10/1981 Natzke ..... E02F 3/3622 403/316
4,871,292 A * 10/1989 Milanowski ..... E02F 3/3618 172/272

(Continued)

FOREIGN PATENT DOCUMENTS

CA 2815032 10/2014
CH 703286 12/2011

(Continued)

OTHER PUBLICATIONS

Search Report dated Jan. 11, 2016, issued in GB 1520732.7 (2 pages).

(Continued)

*Primary Examiner* — Gerald McClain

(57) ABSTRACT

An apparatus to couple the work tool to the arm assembly is disclosed. The arm assembly may have at least one arm. The work tool may have at least one recess. The apparatus may have at least one pin member adapted to engage with the at least one arm and the at least one recess. The at least one pin member may rotate in the at least one recess between a locked orientation and an unlocked orientation. The at least one pin member couples the work tool to the arm assembly in the locked orientation, and the work tool is separable from the arm assembly in the unlocked orientation.

16 Claims, 8 Drawing Sheets

(56) References Cited

U.S. PATENT DOCUMENTS

| | | | | |
|---|---|---|---|---|
| 5,382,110 | A * | 1/1995 | Perotto | E02F 3/3622 172/272 |
| 5,400,531 | A | 3/1995 | Brown | |
| 5,549,440 | A * | 8/1996 | Cholakon | E02F 3/3622 37/468 |
| 5,597,283 | A | 1/1997 | Jones | |
| 5,927,665 | A | 7/1999 | Grabnic | |
| 6,158,950 | A * | 12/2000 | Wilt | E02F 3/3622 37/468 |
| 6,606,805 | B2 | 8/2003 | Kimble et al. | |
| 7,014,385 | B2 | 3/2006 | Lim et al. | |
| 8,469,623 | B2 | 6/2013 | Luyendijk et al. | |
| 9,809,946 | B2 * | 11/2017 | Van Gemert | E02F 3/3686 |
| 2001/0051093 | A1 | 12/2001 | Riccardi | |
| 2003/0131505 | A1 | 7/2003 | Heiple | |
| 2003/0133779 | A1 | 7/2003 | Heiple | |
| 2004/0245002 | A1 | 12/2004 | Muroto | |
| 2006/0237201 | A1 | 10/2006 | Moriuchi | |
| 2007/0201973 | A1 | 8/2007 | McDermott et al. | |

FOREIGN PATENT DOCUMENTS

| | | | |
|---|---|---|---|
| DE | 4109783 | | 9/1991 |
| ES | 2304330 | | 10/2008 |
| GB | 2169582 | | 7/1986 |
| GB | 2522420 | | 7/2015 |
| GB | 2522420 | A * | 7/2015 |
| GB | 2522454 | | 7/2015 |

OTHER PUBLICATIONS

Search Report dated Jan. 19, 2016, issued in GB 1520728.5 (1 page).

Search Report dated Jan. 19, 2016, issued in GB 1520735.0 (2 pages).

* cited by examiner

APPARATUS AND METHOD FOR COUPLING WORK TOOL TO A MACHINE

CLAIM FOR PRIORITY

This application claims benefit of priority of United Kingdom Patent Application No. GB 1520728.5, filed Nov. 24, 2015, which is incorporated herein by reference.

TECHNICAL FIELD

The present disclosure relates to engaging work tools to machines, and more particularly it relates to an apparatus and a method for assembling a work tool to an arm assembly of a machine.

BACKGROUND

Machines, such as, hydraulic excavators, hydraulic shovels, backhoe loaders and the like, are often required to perform different kinds of work on a work site. Therefore, different work tools, such as buckets, hammers, rippers, and grapples, may have to be engaged with an arm assembly (including for example, sticks and booms) of the machine. It is known that the process of removing one work tool from the arm assembly and replacing the work tool with a different work tool may be a time consuming and difficult process. Quick couplers have been employed to enable quick engagement of the stick and the work tool and the quick couplers do, to an extent, reduce effort required for removing the work tool and replacing it. However, such quick couplers add weight to the stick end and build up the stick height/length. As a result, the machine's capabilities may be compromised.

For example, a U.S. Pat. No. 6,606,805 B2 ('805 patent) describes an arm assembly for an excavator. The arm assembly of the '805 patent includes a quick coupler integrated into an arm member and an implement link member. The arm member includes a proximal end adapted for connection to an associated boom for pivoting movement about a transverse pivot axis, a distal end spaced from the proximal end along a first longitudinal axis, and a first recess defined in the distal end. The first recess is defined about a first transverse axis that lies parallel to the transverse pivot axis and includes an open mouth and a closed inner end. The implement link member includes: (i) a first end; and, (ii) a second end spaced from the first end along a second longitudinal axis and defining a second recess about a second transverse axis parallel to the first transverse axis. The second recess has an open mouth and a closed inner end, and the first and second recesses are adapted for respective receipt of first and second associated pins of an associated implement. One or more dude links maintain a fixed spacing between the recesses and capture at least one of the pins of the associated implement in its respective recess at all times. An additional lock member closes the mouth of at least one of the recesses after an associated pin is received therein.

SUMMARY OF THE DISCLOSURE

The present disclosure provides an apparatus for coupling a work tool to an arm assembly of a machine. The arm assembly includes at least one arm and the work tool includes at least one engagement means. The apparatus includes at least one pin member adapted to engage with the at least one arm and the at least one engagement means.

Further, the at least one pin member is adapted to rotate in the at least one engagement means between a locked orientation and an unlocked orientation. The at least one pin member coupled the work tool to the arm assembly in the locked orientation and the work tool is separable from the arm assembly in the unlocked orientation.

The present disclosure further provides a machine comprising the aforementioned apparatus. In a further embodiment, the present disclosure may further provide an arrangement comprising aforementioned apparatus, arm assembly and work tool.

The present disclosure further provides a method for coupling the work tool with the arm assembly of the machine. The method includes engaging the at least one pin member with the at least one arm of the arm assembly. The method further includes engaging the at least one pin member with the at least one engagement means in the unlocked orientation of the at least one pin member. The method further includes rotating the at least one pin member from the unlocked orientation to the locked orientation, where the at least one pin member couples the work tool to the arm assembly in the locked orientation.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
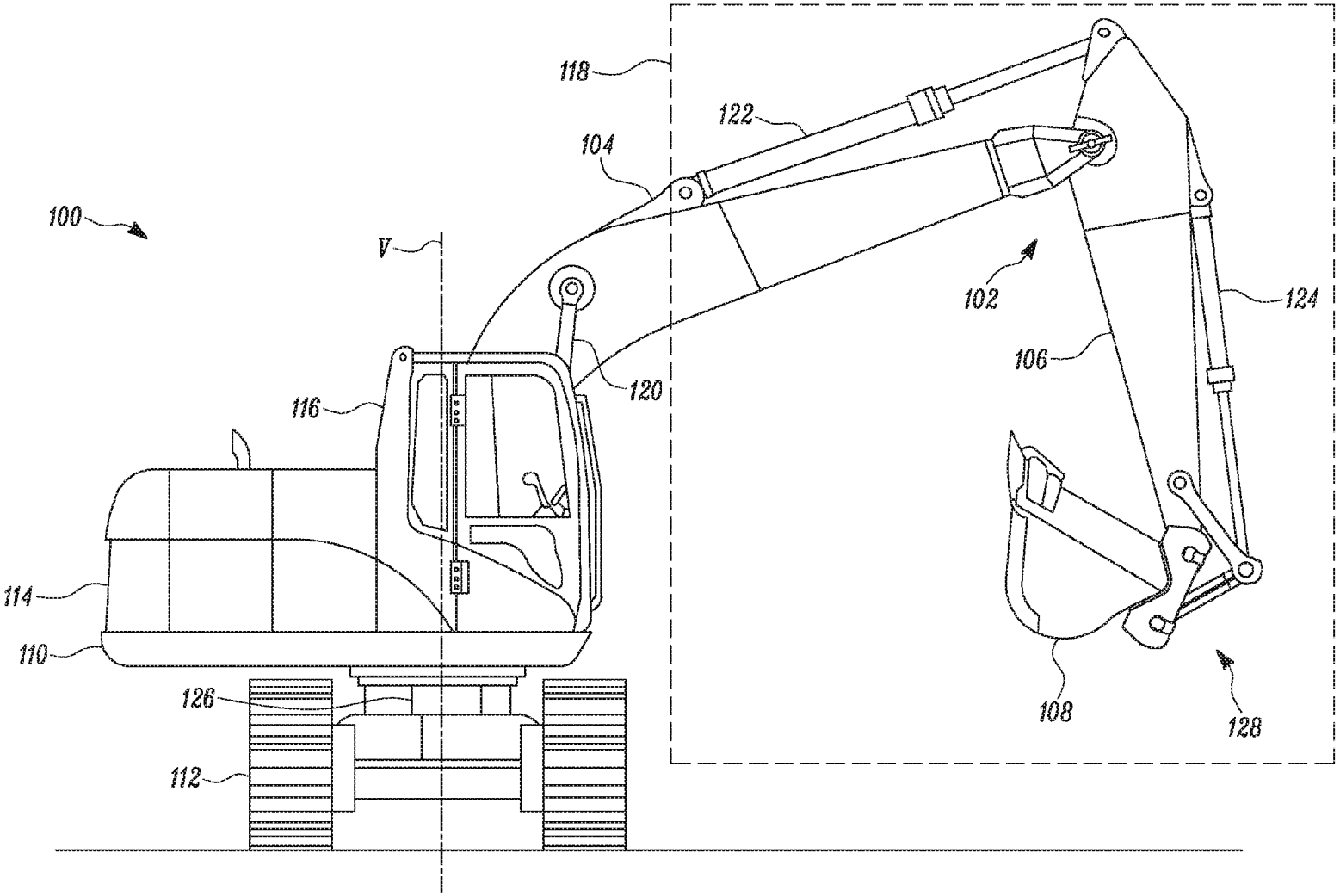
FIG. 1 illustrates a side view of a machine equipped with an arm assembly, according to an embodiment of the present disclosure.

FIG. 1 illustrates a side view of an exemplary machine 100 equipped with an arm assembly 102, according to an embodiment of the present disclosure. The machine 100 may be an excavator, a material handler, a long reach excavator, a foundation drill, a rock drill, a piling machine, a tunneling machine, or a front shovel. In the illustrated embodiment, the machine 100 is shown to be an excavator-type earth-moving or logging machine. Further, the arm assembly 102 includes linkages such as a boom 104, at least one arm, such as a first arm 106, and a work tool 108. The boom 104 may be pivotally connected to a chassis 110 of the machine 100, the first arm 106 may be pivotally connected to the boom 104, and the work tool 108 may be pivotally connected to the first arm 106.

The machine 100 may also include a drive unit 112, such as tracks for propelling the machine 100, a power source 114 to power the arm assembly 102 and the drive unit 112, and an operator cabin 116 for hosting user interface devices for controlling the arm assembly 102 and the drive unit 112. The power source 114 may embody an engine, such as a diesel engine, a gasoline engine, a gaseous fuel-powered engine, or any other type of combustion engine known in the art. The power source 114 may alternatively embody a non-combustion source of power such as a fuel cell, a power storage device, or another source known in the art. The power source 114 may produce a mechanical or electrical power output that may then be converted to hydraulic power for moving the arm assembly 102 and the work tool 108.

Further, an overall movement of the work tool 108 in a first vertical plane 118 (shown in FIG. 1) may be achieved in three parts, first by raising and lowering the boom 104 with respect to the chassis 110, second by moving the first arm 106 toward and outward with respect to the operator cabin 116, and third by rotating the work tool 108 relative to the first arm 106. The boom 104 may be raised and lowered by a pair of first hydraulic actuators 120. The first arm 106 may be moved toward and outward with respect to the operator cabin 116 by a second hydraulic actuator 122. In addition, a third hydraulic actuator 124 may be used to curl and uncurl the work tool 108 relative to the first arm 106. Furthermore, the chassis 110 and the arm assembly 102 may be rotated about a vertical axis V (Shown in FIG. 1) by a fourth hydraulic actuator 126, such as a hydraulic motor, with respect to the drive unit 112.

According to an aspect of the present disclosure, the machine 100 includes a coupling apparatus 128 (also referred to as "apparatus 128") for coupling the work tool 108 to the arm assembly 102, to aid in the curling and uncurling movements of the work tool 108 with respect to the first arm 106. The various components of the coupling apparatus 128 are described in details in the following paragraphs.

Figure 2:
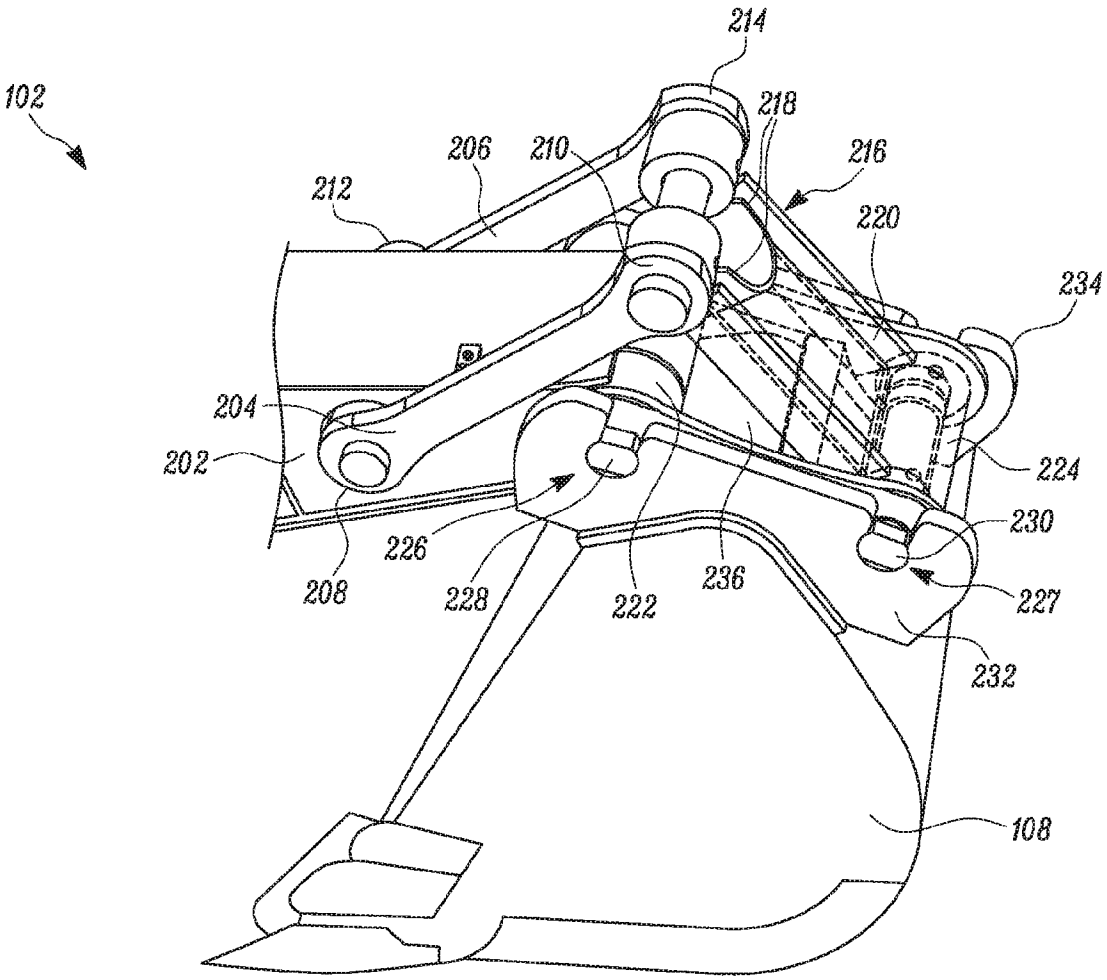
FIG. 2 illustrates the arm assembly equipped with an apparatus for coupling a work tool to the arm assembly, according to an embodiment of the present disclosure.

FIG. 2 illustrates the arm assembly 102 and the coupling apparatus 128 operably coupled to the arm assembly 102, in accordance with an embodiment of the present disclosure. As described earlier, the arm assembly 102 includes the first arm 106, which extends longitudinally away from the operator cabin 116. In one example and for the purpose of this description, the first arm 106 is considered to have a rectangular cross-section, and accordingly the first arm 106 has a first side 202 and a second side (not shown) opposite to the first side 202. Further, the arm assembly 102 includes a first connecting arm 204 and a second connecting arm 206. The first connecting arm 204 has a first end 208 and a second end 210. The first end 208 of the first connecting arm 204 is adapted to be attached to the first side 202 of the first arm 106 and the second end 210 of the first connecting arm 204 is disposed distant from the surface of the first arm 106. Similarly, the second connecting arm 206 has a first end 212 and a second end 214. The first end 212 of the second connecting arm 206 is adapted to be attached to the second side of the first arm 106 and the second end 214 of the second connecting arm 206 is disposed distant from the surface of the first arm 106. In one example, the first connecting arm 204 and the second connecting arm 206 may be positioned inclined with a certain angle with respect to the first arm 106.

The arm assembly 102 may further include a second arm 216 having a first end 218 and a second end 220. The first end 218 of the second arm 216 is attached to the second end 210 of the first connecting arm 204 and the second end 214 of the second connecting arm 206. Further, the second end 220 of the second arm 216 is disposed distant from the first end 218, such that the second arm 216 is inclined to the first connecting arm 204 and the second connecting arm 206. In an embodiment of the present disclosure, the first arm 106 may be a stick end of the arm assembly 102, and the second arm 216 may be a push bar.

For the purpose of coupling the coupling apparatus 128 to the arm assembly 102, the arm assembly 102 comprises at least one mounting means, such as a first mounting means 222 and a second mounting means 224. In said implementation, the first mounting means 222 is located at an end portion of the first arm 106, as shown in FIG. 2, and the second mounting means 224 is located at the second end 220 of the second arm 216. The first mounting means 222 and the second mounting means 224 may be, in an example, provided as hollow cylindrical components with internal passageways.

The coupling apparatus 128 includes at least one pin member, such as a first pin member 228 and a second pin member 230. In the illustrated embodiment the first and second pin members 228, 230 are located and rotatably mounted in the internal passageways of the hollow cylindrical components forming the first and second mounting means 222, 224.

The work tool 108 includes at least one engagement means, such as a first engagement means 226 and a second engagement means 227. The first engagement means 226 and the second engagement means 227 are adapted to aid in coupling the work tool 108 to the first mounting means 222 and the second mounting means 224. As illustrated in FIG. 2, the first engagement means 226 and the second engagement means 227 are formed on a first side member 232 and a second side member 234 separated by a base member 236. Accordingly, the first engagement means 226 and the second engagement means 227 may be engaged with the first mounting means 222 and the second mounting means 224, respectively, with the aid of the first pin member 228 and the second pin member 230, respectively.

Figure 3:
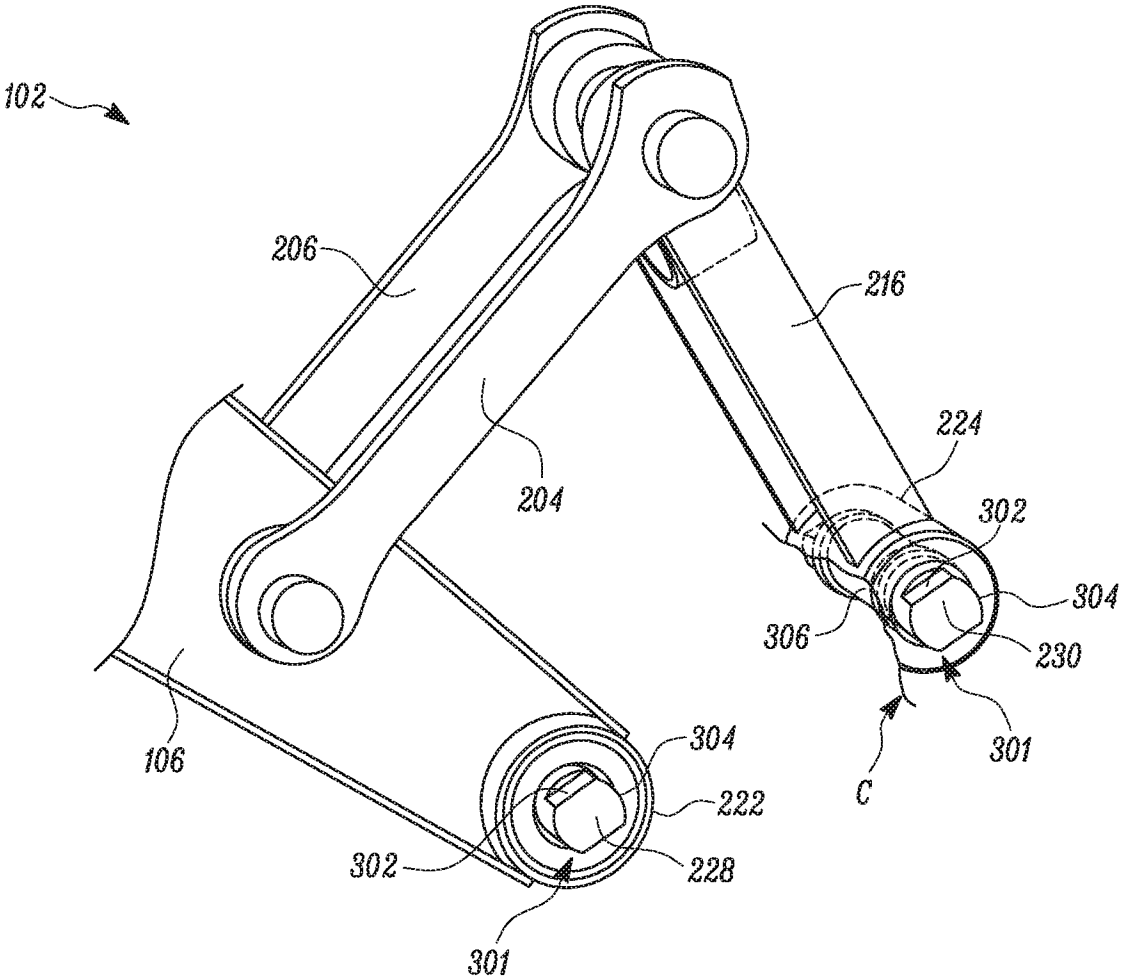
FIG. 3 illustrates pin members of the coupling apparatus of FIG. 2, according to an embodiment of the present disclosure.

FIG. 3 illustrates the arm assembly 102 with the first mounting means 222 and the second mounting means 224 having the first pin member 228 and the second pin member 230 disposed therein respectively. The first pin member 228 and the second pin member 230 are adapted to rotate about their respective longitudinal axis. In other words, the first pin member 228 is rotatably received in the first mounting means 222 and the second pin member 230 is rotatably received in the second mounting means 224.

In accordance with an embodiment of the present disclosure, the first pin member 228 and the second pin member 230 include a profile at their respective ends. For instance, one end of the first pin member 228, as shown in FIG. 3, includes an engagement portion 301 and profile of the engagement portion 301 is configured to engage with the first engagement means 226 and the second engagement means 227 of the work tool 108. In one embodiment, the profile of the engagement portion 301 may include two parallel edges connected by two rounded edges, where the combination of the parallel edges and the rounded edges form a rounded rectangular shape. Although FIG. 3 illustrates the engagement portion 301 on one end of each of the first pin member 228 and the second pin member 230, it will be understood that the other end of the first pin member 228 and the second pin member 230 may also be provided with engagement portions 301 having identical profile. In addition, the body of the first pin member 228 and the second pin member 230 between its respective ends may be cylindrical in structure. However, for the purpose of description, the end of the first and second pin members 228, 230 may be considered to have a flat portion 302 and an arcuate portion 304. Further, FIG. 3 illustrates a cut section 'C' to show a cylindrical portion 306 of the second pin member 230. Furthermore, although the description herein is with respect to two pin members and two arms, it will appreciated that the coupling apparatus 128 of the present disclosure can include at least one pin member engaged with the at least one arm.

Figure 4:
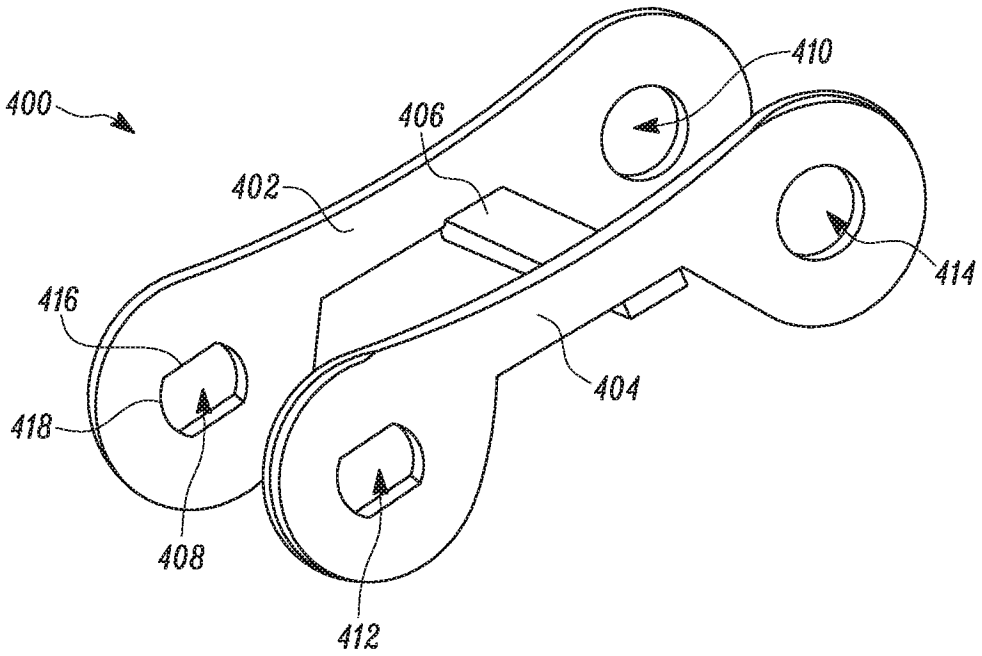
FIG. 4 illustrates a frame of the coupling apparatus, according to an embodiment of the present disclosure.

In one implementation, the coupling apparatus 128 can further include a frame 400, as shown in FIG. 4. The frame 400 is adapted to be engaged with the first pin member 228 and the second pin member 230. For the purpose, the frame 400 includes a first plate 402, a second plate 404, and a support 406, which may be in the form of a plate, connected between the first plate 402 and the second plate 404. The first plate 402 includes a first rounded rectangular aperture 408 and a first circular aperture 410. Similarly, the second plate 404 of the frame 400 includes a second rounded rectangular aperture 412 and a second circular aperture 414. Further, the first rounded rectangular aperture 408 includes a flat portion 416 and an arcuate portion 418. In order to engage the frame 400 with the first pin member 228, the flat portion 416 and the arcuate portion 418 of the first rounded rectangular aperture 408 are provided in a manner to correspond to the flat portion 302 and the arcuate portion 304 of the first pin member 228. In addition, the first circular aperture 410 and the second circular aperture 414 are provided in a manner, such that the circumference of the circular apertures 410, 414 receives the ends of the second pin member 230 without any interference.

The length of the support 406 is predetermined based on the length of the first pin member 228 and the second pin member 230. Further, the first plate 402 and the second plate 404 may be formed in any suitable shape and design so that to be engaged and coupled with the work tool 108 and the arm assembly 102. For example, the first plate 402 and the second plate 404 may be shaped as bars or blocks or a combination thereof. Further, the apertures provided in the first plate 402 and the second plate 404 may be separated by a suitable distance, such that the apertures can be engaged with the respective pin members 228 and 230. Accordingly, the frame 400 may be suitably engaged to the arm assembly 102.

Figure 5:
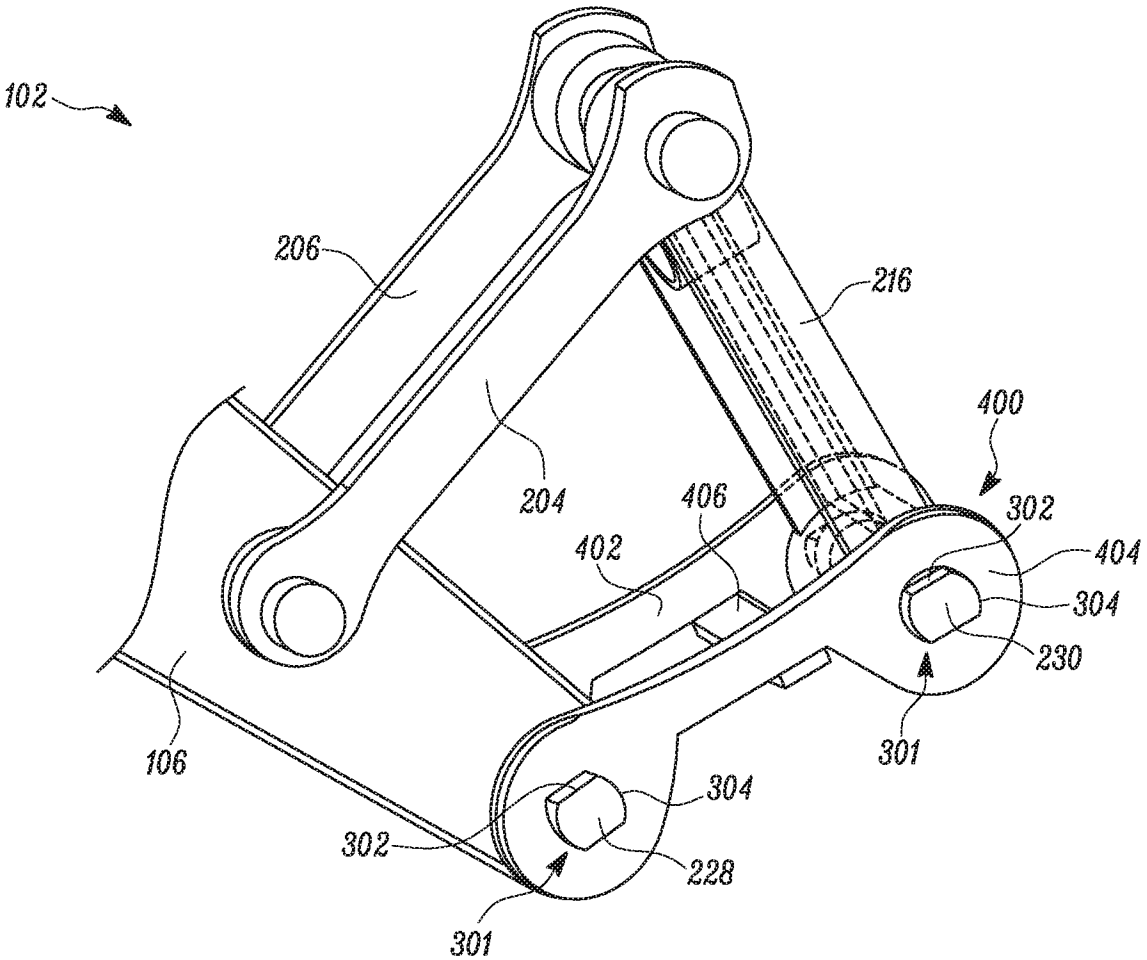
FIG. 5 illustrates the frame coupled to the arm assembly, according to an embodiment of the present disclosure.

Although FIG. 5 shows an assembled view of the frame 400 with the arm assembly 102, this paragraph describes the manner in which the frame 400 is coupled or assembled to the arm assembly 102. As described earlier, the first mounting means 222 and the second mounting means 224 are embodied as hollow cylindrical portion. As such, the first mounting means 222 and the second mounting means 224 include internal passageways therein, respectively. In order to couple or assemble the frame 400 to the arm assembly 102, the frame 400 is positioned to a first assembling position. The first rounded rectangular aperture 408 and the second rounded rectangular aperture 412 are aligned with the internal passageway of the first mounting means 222 in the first assembling position. In addition, the first circular aperture 410 and the second circular aperture 414 are aligned with the internal passageway of the second mounting means 224 in the first assembling position. Subsequently, the first pin member 228 is aligned with respect to the internal passageway of the first mounting means 222, such that the flat portion 302 and the arcuate portion 304 of the first pin member 228 corresponds to the flat portion 416 and the arcuate portion 418 of the rounded rectangular apertures 408, 412. In the aligned position, the first pin member 228 is inserted coaxially through the rounded rectangular apertures 408, 412 and the first mounting means 222. The first pin member 228 therefore cannot rotate relative to the frame 400. Thereafter, the second pin member 230 is coaxially inserted through the circular apertures 410, 414 and the second mounting means 224. The second pin member 230 therefore can rotate relative to the frame 400. Accordingly, the frame 400 is coupled to the arm assembly 102.

Figure 6:
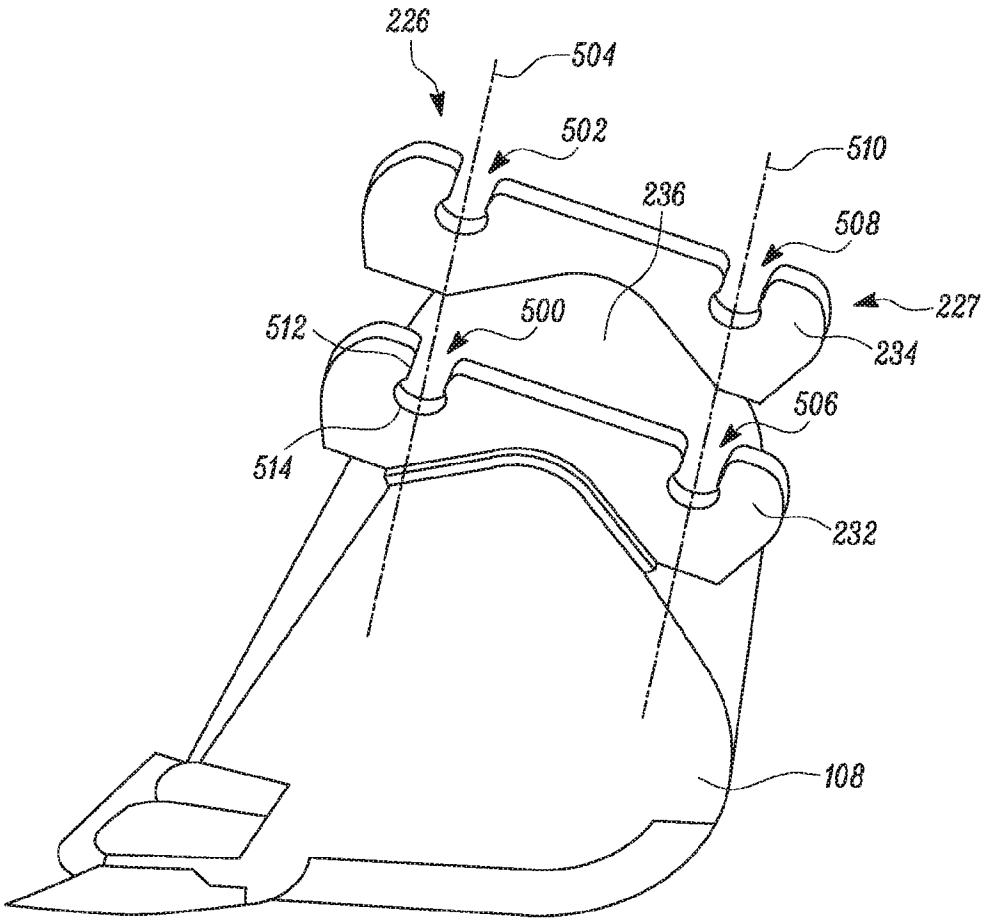
FIG. 6 illustrates an engagement means attached to a work tool, according to an embodiment of the present disclosure.

FIG. 6 shows a work tool sub assembly including the first side member 232 and the second side member 234 attached to the work tool 108. The first side member 232 and the second side member 234 may be attached to the sides of the base member 236. Further, the base member 236 may be adapted to be attached to the work tool 108, as illustrated in FIG. 6. In one example, the base member 236 may be welded to the work tool 108. In another example, the first side member 232 and the second side member 234 may be formed as integral parts of the work tool 108. Further, the first side member 232 and the second side member 234 may be attached to the work tool 108 in various other ways, as would be known to a person skilled in the art, albeit with few variations to the structure of the first side member 232, the second side member 234, and the work tool 108 illustrated in FIG. 6.

According to an aspect of the present disclosure, the first engagement means 226 includes a first recess 500 and a second recess 502 provided on the first side member 232 and the second side member 234, respectively. As such, the first recess 500 and the second recess 502 are aligned with respect to a first axis 504, as shown in FIG. 6. Similarly, the second engagement means 227 includes a third recess 506 and a fourth recess 508 provided on the first side member 232 and the second side member 234, respectively. The third recess 506 and the fourth recess 508 are aligned with respect to a second axis 510, as shown in the FIG. 6. As described earlier, the first engagement means 226 is formed at the predetermined distance from the second engagement means 227, such that the work tool 108 can be coupled with the first mounting means 222 and the second mounting means 224, respectively. Further, each of these recesses includes a neck portion 512 leading to a receiving portion 514. The neck portion 512 is formed as a narrow portion with respect to the receiving portion 514, as show in the FIG. 6. Additionally, the width of the neck portion 512 is predetermined based on the distance between the flat portions 302 of the pin members 228, 230. Further, the receiving portion 514 includes a semi-circular section, where diameter of the semi-circular section is substantially equal to the diameter of the arcuate portion 304 of the pin members 228, 230.

Figure 7:
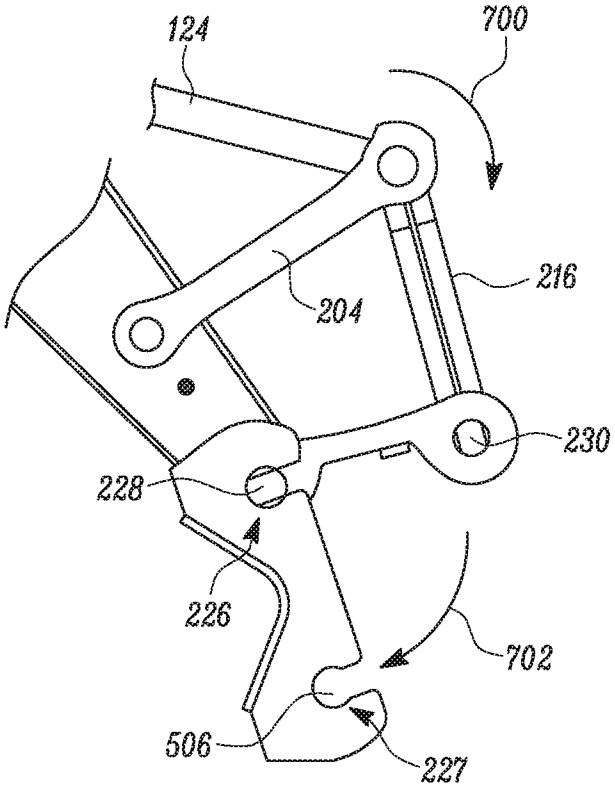
FIG. 7 illustrates an operation to couple the engagement means and the work tool to the arm assembly by the coupling apparatus, according to an embodiment of the present disclosure.

FIG. 7 shows a manner in which the engagement means 226 and 227 are coupled or assembled to the arm assembly 102. In order to couple or assemble the work tool 108 to the arm assembly 102, the work tool 108 is positioned at a second assembling position. The first recess 500 and the second recess 502 are aligned with the internal passageway of the first mounting means 222. Here, it should be understood that the work tool 108 is being assembled to the arm assembly 102 that may already have the frame 400 coupled to it, as described earlier in the FIG. 5. As such, it will be appreciated that the distance between the first side member 232 and the second side member 234 may be set, such that the frame 400 can be received therebetween. In other words, distance between the first side member 232 and the second side member 234 may be greater than the width of the frame 400.

Figure 8:
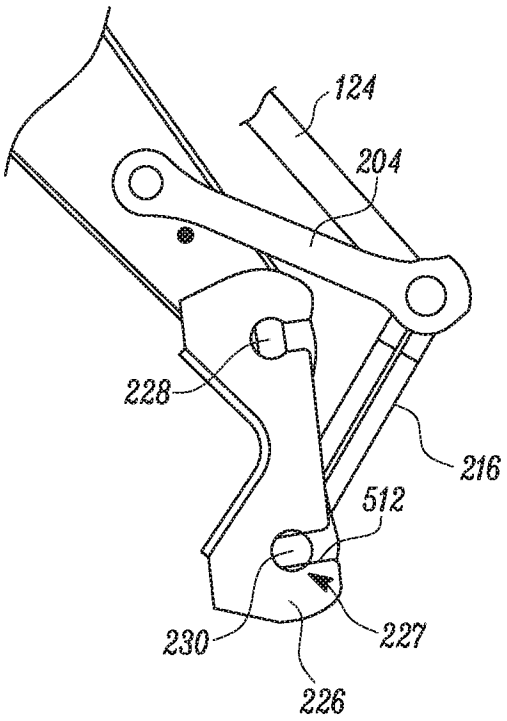
FIG. 8 illustrates an unlocked orientation of a pin member with respect to a recess of the engagement means, according to an embodiment of the present disclosure.

Additionally, while positioning the engagement means 226 and 227 in the second assembling position, it may be ensured that the first pin member 228 is positioned in a certain orientation, with respect to the first recess 500 and the second recess 502, such that the flat portions 302 of the first pin member 228 is received in the neck portions 512 of the first recess 500 and the second recess 502. In such a condition, the end of the work tool 108 having the first recess 500 is engaged with the first pin member 228, as shown in FIG. 7. Further, the first connecting arm 204 is moved in a first downward direction 700 with the aid of the third hydraulic actuator 124, to engage the second pin member 230 with the third recess 506 and the fourth recess 508 of the second engagement means 227. Since the first pin member 228 is engaged with the first recess 500 and the second recess 502 of the first engagement means 226, the frame 400 pivotally moves in a second downward direction 702. Simultaneously, at the other end of the work tool 108, the first pin member 228 rotates to occupy the receiving portion 514 of the first recess 500 and the second recess 502. Here, it should be noted that the profile of the engagement portions 301 at the ends of the first pin member 228 corresponds to the first and second rounded rectangular apertures 408, 412 of the frame 400. As such, the first pin member 228 rotates while the frame 400 rotates in the second downward direction 702. In other words, the rotation of the first pin member 228 is dependent on the rotation of the frame 400. For the purpose of convenience in this description, a condition in which the pin members 228, 230 are received in the respective apertures with the flat portions 302 of the pin members 228, 230 being parallel to the neck portions 512, may be referred to as an unlocked orientation, as shown in FIG. 8. Further, a condition in which the pin members 228, 230 are occupied in the respective receiving portions 514 may be referred to as a locked orientation, as shown in FIG. 9.

Figure 9:
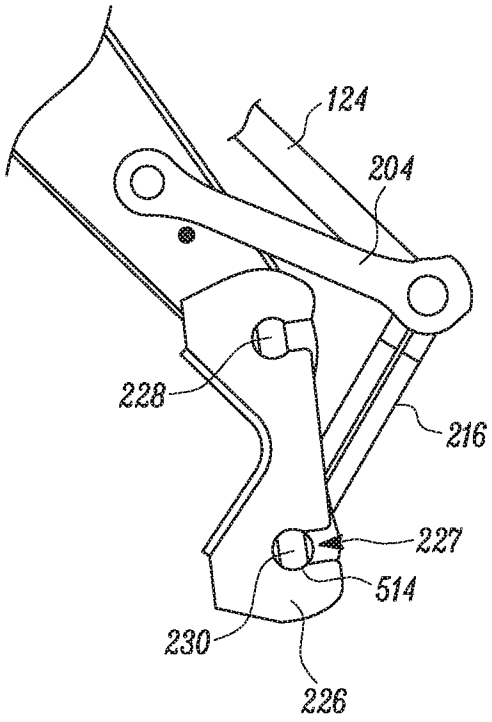
FIG. 9 illustrates a locked orientation of the pin member with respect to the recess of the engagement means, according to an embodiment of the present disclosure.

Since FIG. 8 and FIG. 9 illustrate the coupling operation with a side view of the components, minimum features of the components, such as the first recess 500 of the first engagement means 226, third recess 506 of the second engagement means 227 are shown. As such, it will be understood that both recesses of the engagement means will be considered while reading the following description. In one implementation, the second mounting means 224 which houses the second pin member 230 may include a motor to rotate the second pin member 230 about its longitudinal axis. Since the engagement portions 301 provided at the ends of the second pin member 230 engage with the first and second circular apertures 410, 414, the second pin member 230 is not restricted to rotate, unlike the first pin member 228. When the second pin member 230 is in the vicinity of the second engagement means 227, the second pin member 230 may be rotated to orient it with respect to the neck portions 512 of the third recess 506 and the fourth recess 508. Further operation of the third hydraulic actuator 124 may push the second pin member 230 into the third recess 506 and the fourth recess 508, as shown in FIG. 8. Subsequently, the motor may be operated to rotate the second pin member 230 in the third recess 506 and the fourth recess 508, thereby allowing the second pin member 230 to occupy the receiving portions 514 of the third recess 506 and the fourth recess 508, as shown in FIG. 9.

Once the first pin member 228 and the second pin member 230 are actuated to the locked orientation, the side members 232 and 234 of the work tool 108 are rigidly coupled to the arm assembly 102. Further, the work tool 108 may be disengaged from the arm assembly 102 by rotating the second pin member 230 in an opposite direction to bring the second pin member 230 to the unlocked orientation.

Various embodiments disclosed herein are to be taken in the illustrative and explanatory sense, and should in no way be construed as limiting of the present disclosure.

INDUSTRIAL APPLICABILITY

Figure 10:
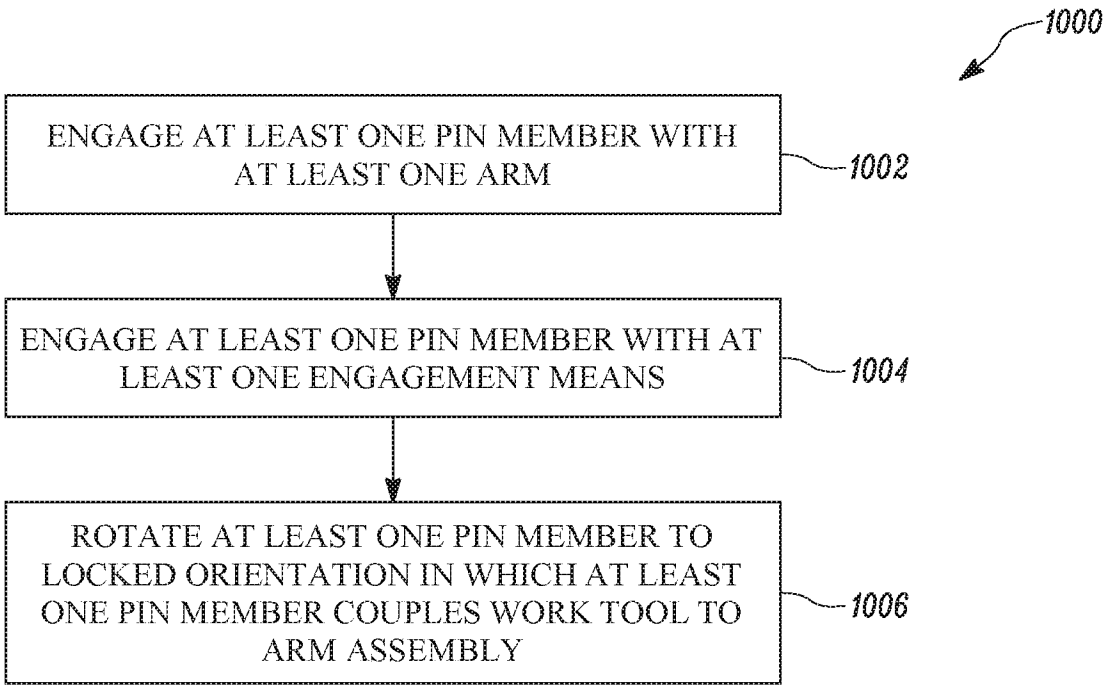
FIG. 10 is a flowchart of a method of coupling the work tool to the arm assembly of the machine, according to an embodiment of the present disclosure.

The present disclosure provides the coupling apparatus 128 for assembling the work tool 108 with the arm assembly 102 of the machine 100. The present disclosure further provides a method 1000 for assembling the work tool 108 with the arm assembly 102. FIG. 10 shows a flowchart of the method 1000, according to an embodiment of the present disclosure. Further, the method 1000 may be implemented in any suitable hardware, such that the hardware employed can perform the steps of the method 1000 readily and on a real-time basis. For the convenience in description, various steps of the method 1000 will be described in conjunction with the preceding figures of the present disclosure.

Referring to FIG. 10, at step 1002, the method 1000 includes engaging the at least one pin member 228, 230 with the at least one arm 204, 206 of the arm assembly 102. In one example embodiment, the arm assembly 102 may include the first connecting arm 204 and the second connecting arm 206 attached to the sides of the first arm 106 of the arm assembly 102. Further, the coupling apparatus 128 may include the first pin member 228 and the second pin member 230 adapted to engage with the at least one arm 204, 208. In one example implementation, the arm assembly 102 may include the first mounting means 222 and the second mounting means 224 adapted to receive the first pin member 228 and the second pin member 230 therein, respectively.

At step 1004, the method 1000 includes engaging the at least one pin member 228, 230 with the at least one engagement means of the work tool 108 in the unlocked orientation of the at least one pin member 228, 230. In one example, the at least one engagement means may include the first engagement means 226 and the second engagement means 227. Each of the first engagement means 226 and the second engagement means 227 may include a recess adapted to engage with the at least one pin member 228, 230. Further, the recess may include the neck portion 512 leading to the receiving portion 514.

Furthermore, at step 1006, the method 1000 includes rotating the at least one pin member 228, 230 from the unlocked orientation to the locked orientation. The at least one pin member 228, 230 couples the work tool 108 to the arm assembly 102 in the locked orientation. Additionally, the at least one pin member 228, 230 abuts against the neck portion 512 in the locked orientation, thereby rigidly holding the work tool 108 with the arm assembly 102. In cases where the work tool 108 needs to be separated or disengaged from the arm assembly 102, the at least one pin member 228, 230 may be rotated back to the unlocked orientation, and subsequently, the frame 400 may be pulled back with the aid of the third hydraulic actuator 124 to release the work tool 108.

Therefore, as it would be understood to the person skilled in the art, the coupling apparatus 128 of the present disclosure provides an easy and efficient assembling of the work tool 108 to the arm assembly 102. Since the coupling or the assembling of the work tool 108 and the arm assembly 102 is assisted by two simple pin members, such as the first pin member 228 and the second pin member 230, the process of coupling can be performed in short duration of time. Further, owing to the presence of such pin members, the coupling apparatus 128 can be replaced or coupled to the arm assembly 102 at any instant of time. Furthermore, since the coupling or the assembling of the work tool 108 and the arm assembly 102 may be carried out by two simple pin members, such as the first pin member 228 and the second pin member 230 provided at the arm assembly 102, overall weight and length of the arm assembly 102 remains substantially same, and therefore capabilities of the machine 100 remain uncompromised.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An apparatus for coupling a work tool to an arm assembly of a machine, the arm assembly comprising a first arm and a second arm and the work tool comprising a first recess and a second recess, wherein the apparatus comprises:
- a first pin member adapted to engage with the first arm and the first recess;
- a second pin member adapted to engage with the second arm and the second recess; and
- a frame adapted to engage with, and prevent relative movement between, each of the first pin member and the second pin member,
- wherein the first pin member is adapted to rotate in the first recess between a locked orientation and an unlocked orientation, and
- wherein the first pin member couples the work tool to the arm assembly in the locked orientation and the work tool is separable from the arm assembly in the unlocked orientation.

2. The apparatus as claimed in claim 1, wherein the first arm comprises at least one annular cylinder, and wherein the first pin member is rotatably disposed in the at least one annular cylinder.

3. The apparatus as claimed in claim 1, wherein the first recess is configured to receive the first pin member.

4. The apparatus as claimed in claim 3, wherein the first recess comprises:
- a neck portion; and
- a receiving portion connected to the neck portion,
- wherein the first pin member is adapted to pass through the neck portion in the unlocked orientation, and the first pin member received in the receiving portion abuts against the neck portion in the locked orientation.

5. The apparatus as claimed in claim 1, wherein the first pin member includes at least one engagement portion, and wherein a profile of the at least one engagement portion is adapted to engage with the first recess, when the first pin member is in the locked orientation, to couple the work tool with the arm assembly.

6. The apparatus as claimed in claim 1, wherein the frame comprises at least one rounded rectangular aperture for engaging with the first pin member and at least one circular aperture for engaging with the second pin member.

7. The apparatus as claimed in claim 6, wherein the frame comprises:
- a first plate having a first circular aperture and a first rounded rectangular aperture;
- a second plate having a second circular aperture and a second rounded rectangular aperture; and
- a support connecting the first plate and the second plate, wherein
  - the first rounded rectangular aperture and the second rounded rectangular aperture are adapted to receive the first pin member; and
  - the first circular aperture and second circular aperture are adapted to receive the second pin member.

8. The apparatus as claimed in claim 7, wherein the at least one engagement portion of the first pin member engages with the first and the second rounded rectangular apertures, and the at least one engagement portion of the second pin member engages with the first and second circular apertures.

9. A machine, comprising:
- an arm assembly comprising at a first arm and a second arm;
- a work tool comprising at a first recess and a second recess; and
- an apparatus configured to couple the work tool to the arm assembly, the apparatus comprising:
  - a first pin member adapted to engage with the first arm and the first recess;
  - a second pin member adapted to engage with the second arm and the second recess; and
  - a frame adapted to engage with, and prevent relative movement between, each of the first pin member and the second pin member, wherein
    - the first pin member is adapted to rotate in the first recess between a locked orientation and an unlocked orientation, and
    - the first pin member couples the work tool to the arm assembly in the locked orientation and the work tool is separable from the arm assembly in the unlocked orientation.

10. The machine of claim 9, wherein the first recess is configured to receive the first pin member.

11. The machine of claim 10, wherein the first recess comprises:
- a neck portion; and
- a receiving portion connected to the neck portion,
- wherein the first pin member is adapted to pass through the neck portion in the unlocked orientation, and the first pin member received in the receiving portion abuts against the neck portion in the locked orientation.

12. The machine of claim 9, wherein the first arm comprises at least one annular cylinder, and wherein the first pin member is rotatably disposed in the at least one annular cylinder.

13. The machine of claim 9, wherein the first pin member includes at least one engagement portion, and wherein a profile of the at least one engagement portion is adapted to engage with the first recess, when the first pin member is in the locked orientation, to couple the work tool with the arm assembly.

14. A method of coupling a work tool to an arm assembly of a machine, the arm assembly having a first arm and a second arm and the work tool having a first recess and a second recess, the method comprising:

engaging a first pin member with the first arm;

engaging a second pin member with the second arm;

engaging a frame with each of the first pin member and the second pin member, preventing relative movement between the first pin member and the second pin member;

engaging the first pin member with the first recess in an unlocked orientation of the at least one pin member; and rotating the first pin member from the unlocked orientation to a locked orientation, wherein the first pin member couples the work tool to the arm assembly in the locked orientation.

15. The method as claimed in claim 14, wherein the step of engaging the first pin member with the first recess comprises inserting, through a neck portion, the first pin member into a receiving portion when the first pin member is in an unlocked orientation.

16. The method as claimed in claim 15, wherein the first pin member abuts against the neck portion in the locked orientation of the first pin member.

* * * * *